United States Patent [19]

Marega

[11] Patent Number: 4,800,659

[45] Date of Patent: Jan. 31, 1989

[54] FOOT-CLAMPING STRUCTURE FOR SHOES AND BOOTS

[75] Inventor: Antonello Marega, Nervesa della Battaglia, Italy

[73] Assignee: Calzaturificio Tecnica Spa, Nervesa della Battaglia, Italy

[21] Appl. No.: 71,442

[22] Filed: Jul. 9, 1987

[30] Foreign Application Priority Data

Jul. 10, 1986 [IT] Italy ..... 22501 B/86

[51] Int. Cl.[4] ..... A43B 5/04; A43C 11/00

[52] U.S. Cl. ..... 36/119; 36/50; 24/695 K

[58] Field of Search ..... 36/117-121, 36/50, 88, 93; 24/68 SR, 69 SK, 70 SK, 71 SK

[56] References Cited

U.S. PATENT DOCUMENTS

| | | | |
|---|---|---|---|
| 4,192,087 | 3/1980 | Salomon | 36/119 |
| 4,205,467 | 6/1980 | Salomon | 36/119 |
| 4,253,251 | 3/1981 | Salomon | 36/119 |
| 4,670,999 | 6/1987 | Olivieri | 36/119 |

FOREIGN PATENT DOCUMENTS

| | | | |
|---|---|---|---|
| 3132040 | 5/1982 | Fed. Rep. of Germany | 36/117 |
| 2576192 | 7/1986 | France | 36/119 |

*Primary Examiner*—James Kee Chi

*Attorney, Agent, or Firm*—Armstrong, Nikaido, Marmelstein & Kubovcik

[57] ABSTRACT

In shoes and boots, in particular ski boots, at least one band-like member can be clamped against the foot or the liner containing whereby the foot is clamped to the shoe or the boot by means of a device readily actuatable and positioned in the front part of the ski boot.

8 Claims, 9 Drawing Sheets

Figure 1:
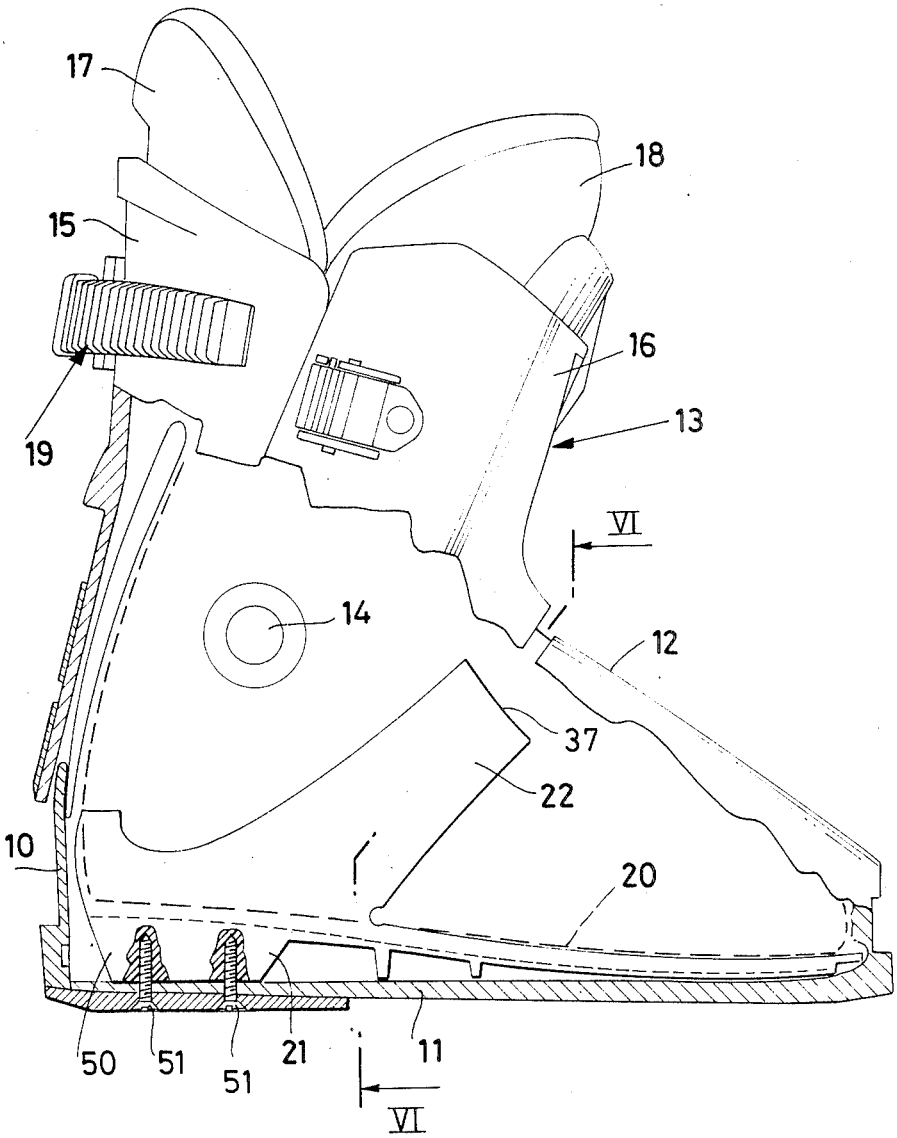
Figure 2:
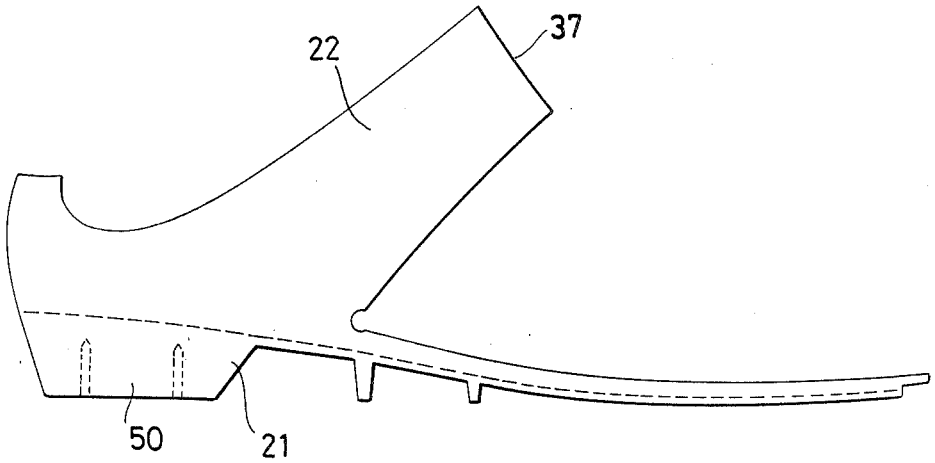

Fig. 4
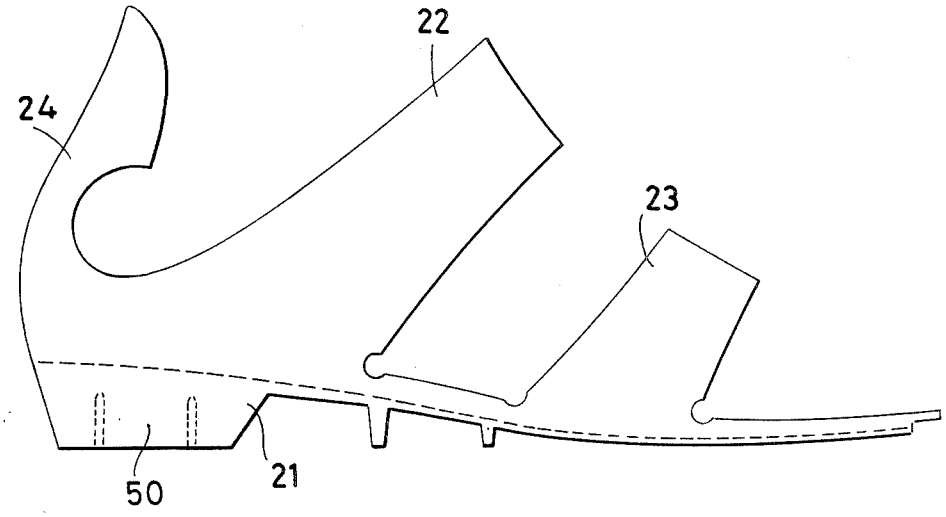
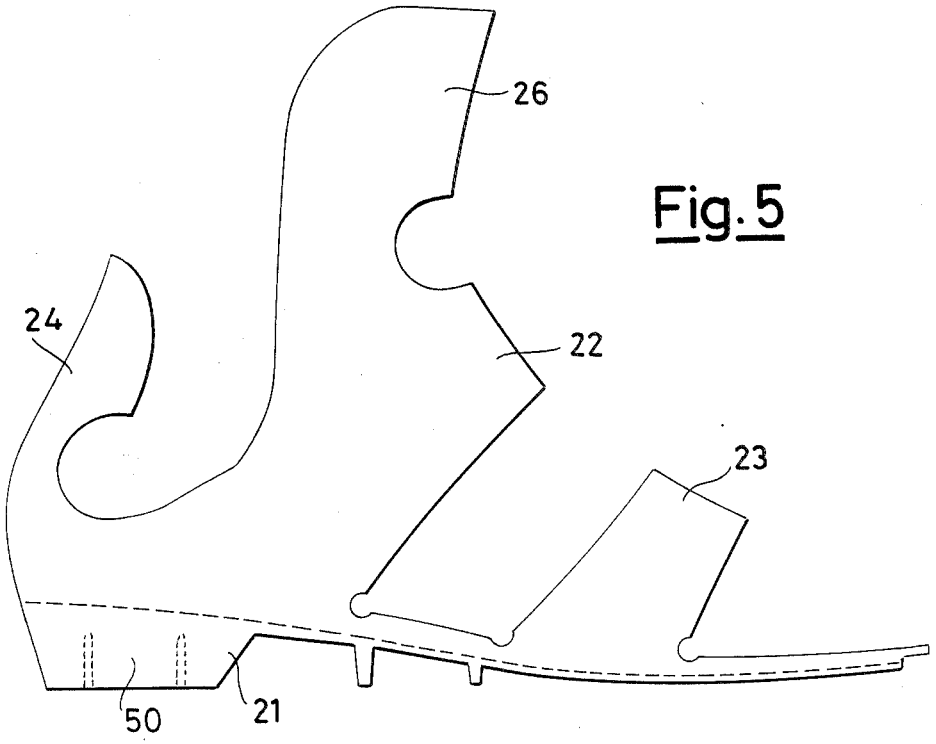
Fig. 5

Fig. 8
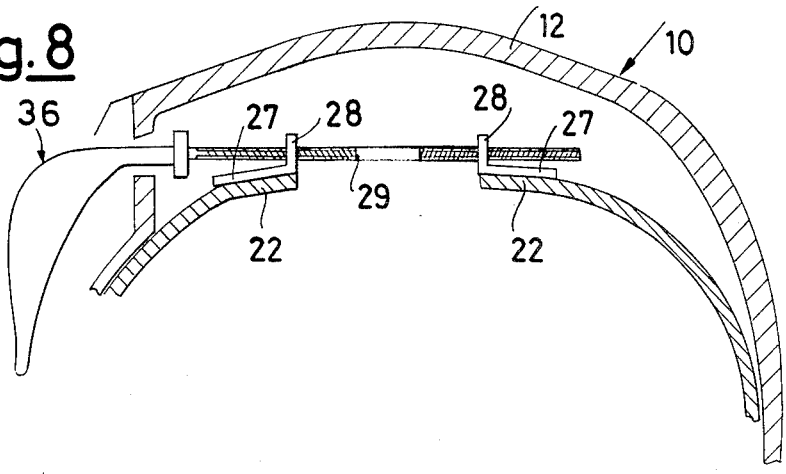
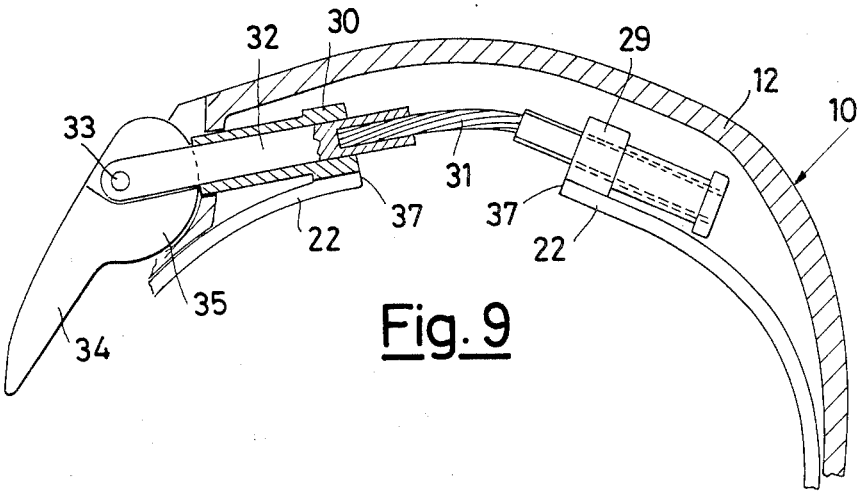
Fig. 9
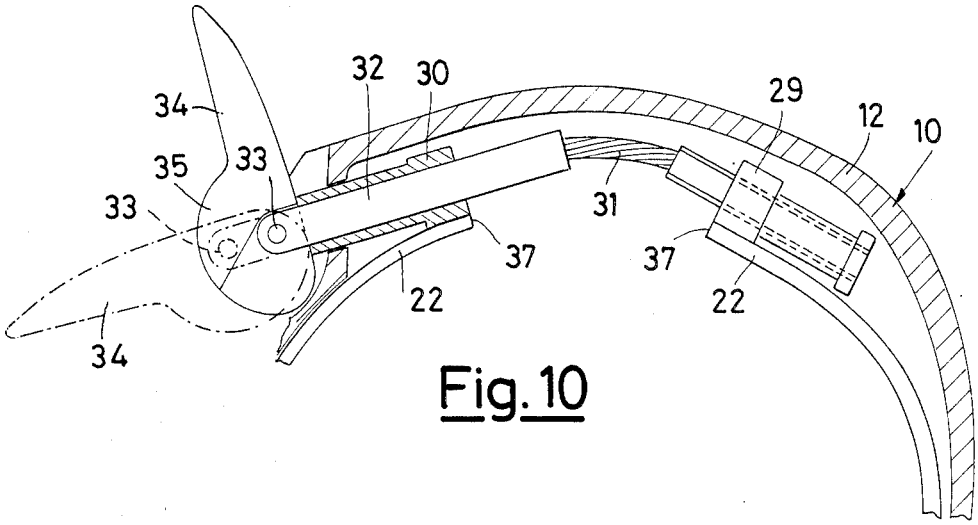
Fig. 10

FOOT-CLAMPING STRUCTURE FOR SHOES AND BOOTS

The present invention relates to an improvement in shoes and boots, in particular ski boots.

In the following description specific reference will be made to ski boots with no limiting intention stated or implied.

Ski boots normally comprise a rigid outer shell and an inner lining of soft material designed to receive the foot and make use of the boot comfortable. To the shell is also fixed a boot leg (usually in such a manner as to permit variation of the inclination of the leg in relation to the ski and hence of the skier's position).

The boot leg is normally formed in two parts which can be opened out and the closing of which encloses in an adjustable and known manner the skier's leg.

If the opening part of the boot leg is the front part, the introduction of the foot is rather difficult and moreover the inner liner must be oversized in relation to the foot, especially at the instep, so that the specific function of the rigid shell is partially cancelled, i.e. the function of clamping the skier's foot to the ski in such a manner that movement and shifting however small of the skier's leg is transmitted to the ski without intermediate play.

In recent years to facilitate shoeing the foot and to improve waterproofness and snowproofness as well as the aerodynamics of the boot, boots of the so-called rear-entry type have been produced. In this case it is the rear part of the boot leg which can be opened and permits easier introduction of the foot in the liner end then in the boot.

The two parts of the boot leg can be closed in an adjustable manner by means of hook and rack devices well known in this field.

It is nevertheless important, as with the above type, to effect clamping of the foot, to achieve which only the aforesaid inner liner can be acted upon.

There has recently been proposed a clamping system for the liner designed to clamp the upper of the liner against the instep and then the foot against the inner sole of the boot (cf. U.S. Pat. No. 4,160,332) by means of tie cables having one end integral with the upper of the liner or with a band-like member at the instep and the other end integral with a lever mounted on the outside of the shell in its rear part. Said tie cables are passed around and under the pins which hinge to the shell the two parts of the boot leg hinged together so that operation of the lever causes tensioning or loosening of the tie cables and clamping of the foot in the inner liner or freeing it therefrom. The lever in question is preferably mounted in the part of the boot leg movable between the open and closed positions so that opening and closing of said part of the boot leg involves operation in the aforesaid manner of said lever. In the preferred embodiment the lever has a plurality of seats or notches at progressively increasing or decreasing distances from said hinge pins and hence of deviation of said tie cables so that by selecting the appropriate seat it is possible to adjust clamping tension on the instep. This structure has constituted a first solution of the problem from the functional viewpoint but it imposes certain structural limitations and in particular makes it necessary to provide the two tie cables and their arrangement and deflection around the hinge pins of the two parts of the boot leg. In other words there are obligatory positions according to a rather long and tortuos path for the two tie cables as is clearly illustrated in the above mentioned U.S. Patent.

In a variant of the above design the tie cables are passed through the aforesaid pins, which thus constitute the upper limit position which said tie cables may occupy.

These designs also have other drawbacks in addition to the aforementioned structural drawbacks.

In the first place pressure from the two tie cables acts specifically at the articulation of the malleolus with not negligible consequences not only for blood circulation in the foot and comfortable use of the boot but also in the sport practice.

To secure clamping of the foot and the associated inner liner the pins which form the joint between the boot leg and the shell have been moved downward. But this involves the drawback that the action applied by the skier is shifted toward the heel of the boot with the resulting greater difficulty or lack of precision in control and mastery of the skis.

The main object of the present invention is to provide a foot clamping structure capable of preserving the advantages secured with the above mentioned design while eliminating the drawbacks briefly outlined above. More specifically the object of the present invention is to produce a foot clamping structure capable of fixing the foot and the inner liner surrounding it in the boot shell by means of one or more band like members acting on the upper surface or dorsum of the foot without the pressure exerted on the foot acting at the malleolus and without moving downward the points of articulation of the boot leg with the shell. At the same time the object of the invention is to fix stably the clamping structure in question to the boot sole ensuring direct transmission of commands and movements imparted by the skier.

These objects are achieved by a foot clamping structure inside a shoe or boot which comprises a sole and an external body or shell as well as an inner sole placed between the bottom of the outer body or shell and the foot or, if provided, the inner liner, characterized in that to a rigid portion of said shell at least one band-like member is connected, engaging the dorsum of the foot or of the inner liner, immediately beneath the malleolus articulation, said at least one band-like member being connected to a clamping device, actuatable from the outside of the shoe or boot and positioned in the front part or upper of the shoe or boot, said clamping device being actuatable between a first open position, in which said at least one band-like member is not pressing against the foot dorsum or the inner liner, and a second clamping position, in which said at least one band-like member is adjustably pressed against the immediately beneath foot dorsum or the inner liner.

According to a first embodiment of the present invention, said at least one band-like member is connected, to particularly integrally formed with, said inner sole and which laterally embraces the foot or the inner liner surrounding it starting from the heel and extending upward to the part of the dorsum of the foot immediately beneath the malleolus articulation, said band-like member being formed in two half-bands separated at the ridge zone of the dorsum of the foot, said clamping device being provided to bring near to each other or separate the adjacent extreme edges of the two half-bands, said device being actuatable from the outside of the shoe or boot.

In accordance with a preferred form of this embodiment of the present invention, said band-like member is formed in such a manner as to surround the heel of the foot, or of the inner liner in case of a ski boot, with the two half-bands extending upward in such a manner as to leave free the bony protuberances of the foot and capable of being closed to clamp the foot or separated to unclamp the foot by said clamping device operated from the outside of the shoe or boot, said inner sole being fixed directly to the sole of the boot.

Said clamping device may comprise known means such as a screw with two opposed threadings engaged in two nut-screw elements formed in the adjacent edges of the two half-bands.

Alternatively said clamping device may consist of a connection by means of a cable or pull fixed to one of the edges of the half-bands and passing through a collar integral with the other adjacent edge and then to the other half-bands and terminating in an external operating lever the closing of which forces running of said collar toward the fixed fastening of the cable to the other edge and consequently causes closing of the two half-band to clamp the foot.

In accordance with another embodiment of the structure in accordance with the invention, with said inner sole there are integrally formed other band-like elements or two half-band elements which embrace the metatarsal zone of the foot and/or the instep above the malleolus articulation and/or the Achilles tendon zone of the foot respectively.

In this embodiment also there are provided band-like elements in the form of two half-bands and a device for clamping and unclamping the foot which engages the two adjacent edges of each pair of half-bands.

Furthermore in the preferred embodiments of the invention requiring two half-bands for each band-like member the mating or overlapping line of the two half-bands is moved laterally in relation to the ridge line of the dorsum, the above said suitable clamping and unclamping device being also consequently moved.

In accordance with a third embodiment of the present invention, said at least one band-like member has one end fixed to the shell of the boot and the other end connected to a tie cable fixed to an anchoring member of said clamping device, said tie cable also engaging a movable member of said clamping device, said movable member being removable from the said fixed anchoring member of said clamping device, upon the latter is brought to the said clamping position, whereby a tension is applied to said tie cable, and consequently said band-like member is clamped against the foot dorsum or the inner liner, if present.

According to a further variation of said third embodiment of the present invention, a further tie cable is fastened to said movable member of said clamping device, said further tie cable being in turn connected at the other end to the first edge of an half-band member, the other edge of which is fastened to the inner sole of the shoe or boot, said half-band member embracing the foot part before the big toe, whereby in the said clamping position of said clamping device said half-band member causes the foot or the inner liner to be securely clamped to the inner sole of the shoe or boot.

Figure 6:
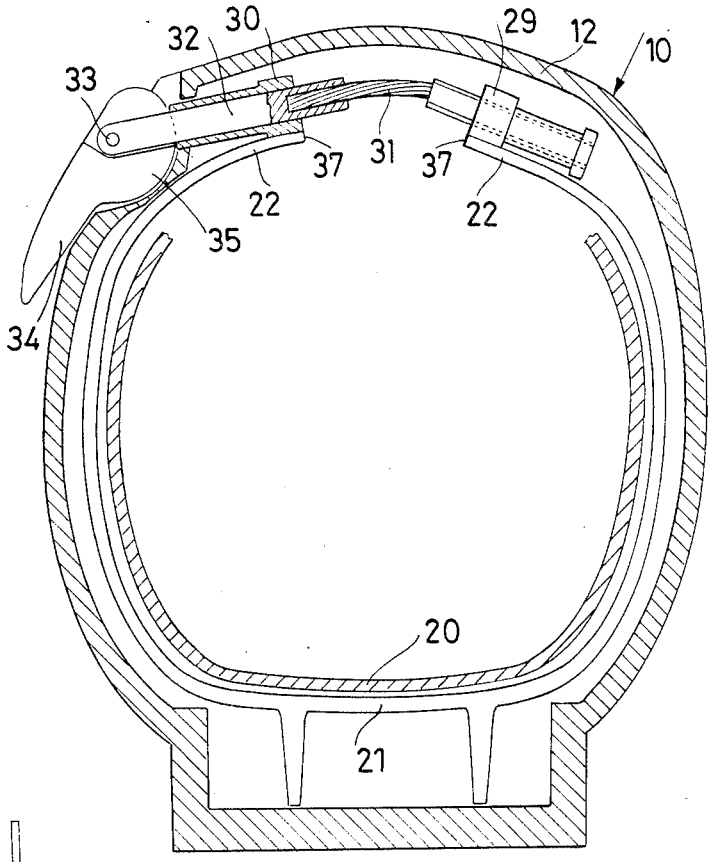
Figure 7:
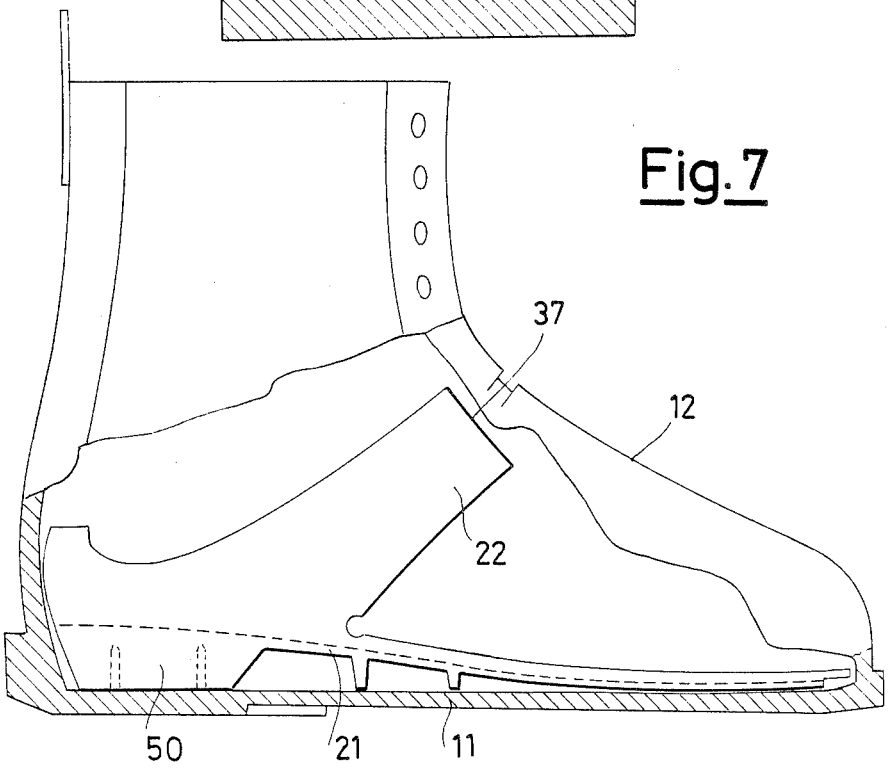

The peculiar features and benefits of the present invention will appear more clearly from the following description given with reference to the annexed drawings wherein:

FIG. 1 is a partially sectional schematic view of a ski boot produced in conformity with the present invention, FIGS. 2, 3, 4 and 5 are schematic side views of the clamping structure in accordance with the present invention separate from the shoe or boot, FIG. 6 is a cross section of the boot of FIG. 1 through plane of cut VI—VI, FIG. 7 is a view similar to FIG. 1 of a shoe or boot produced in conformity with the present invention, FIGS. 8, 9 and 10 are schematic views of details of the clamping device of the structure in accordance with the invention.

Figure 11:
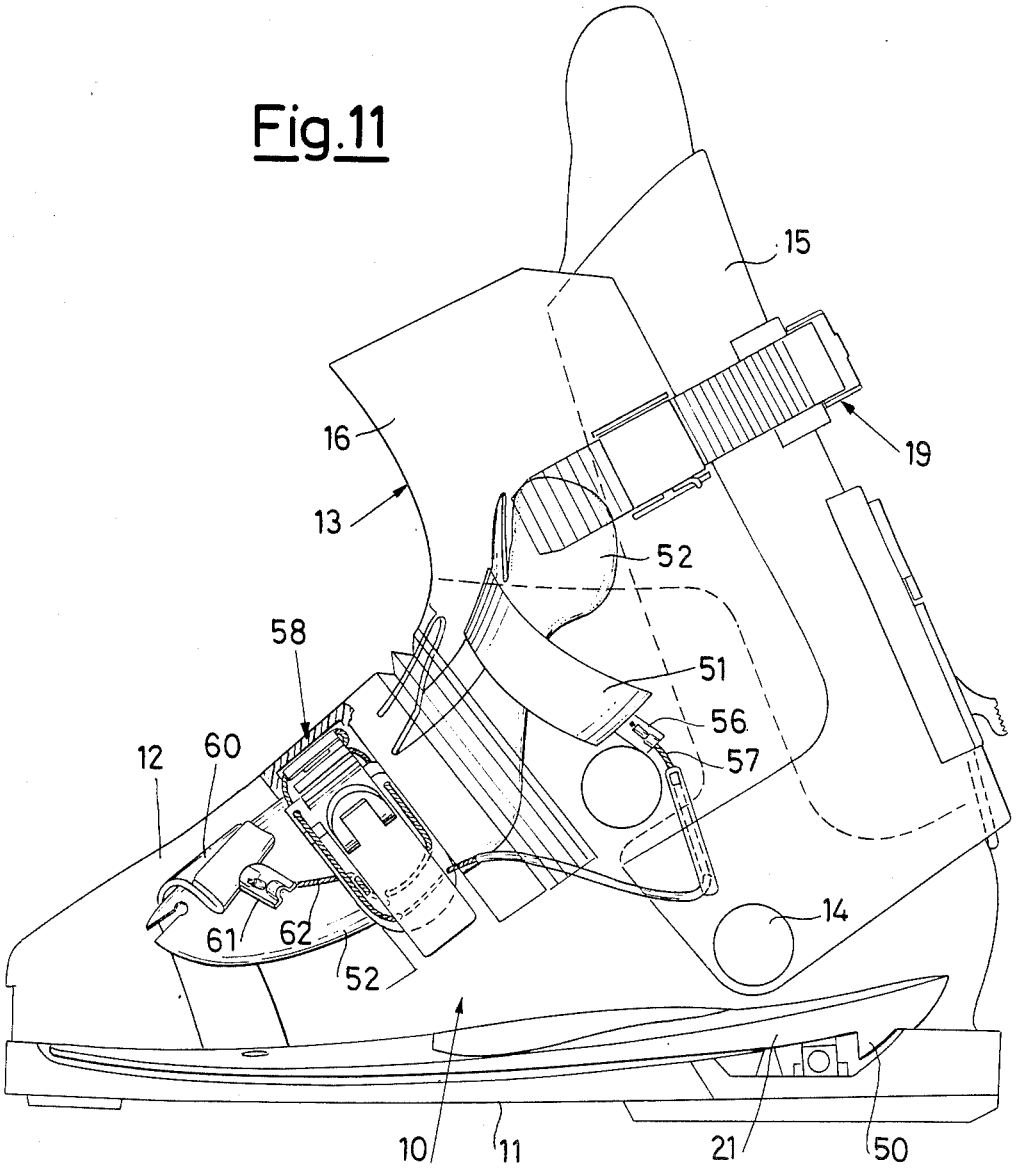
Figure 12:
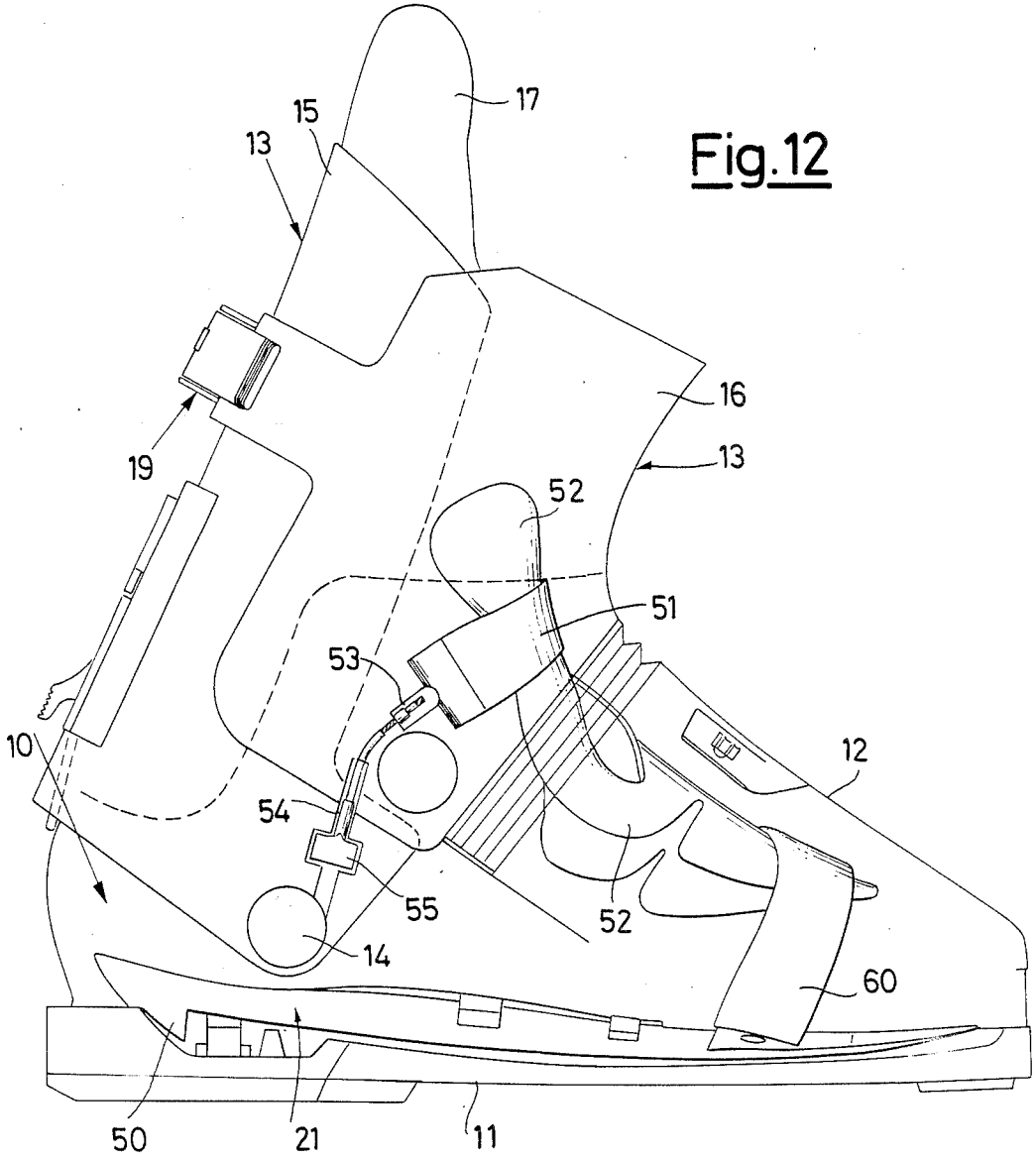
Figure 13:
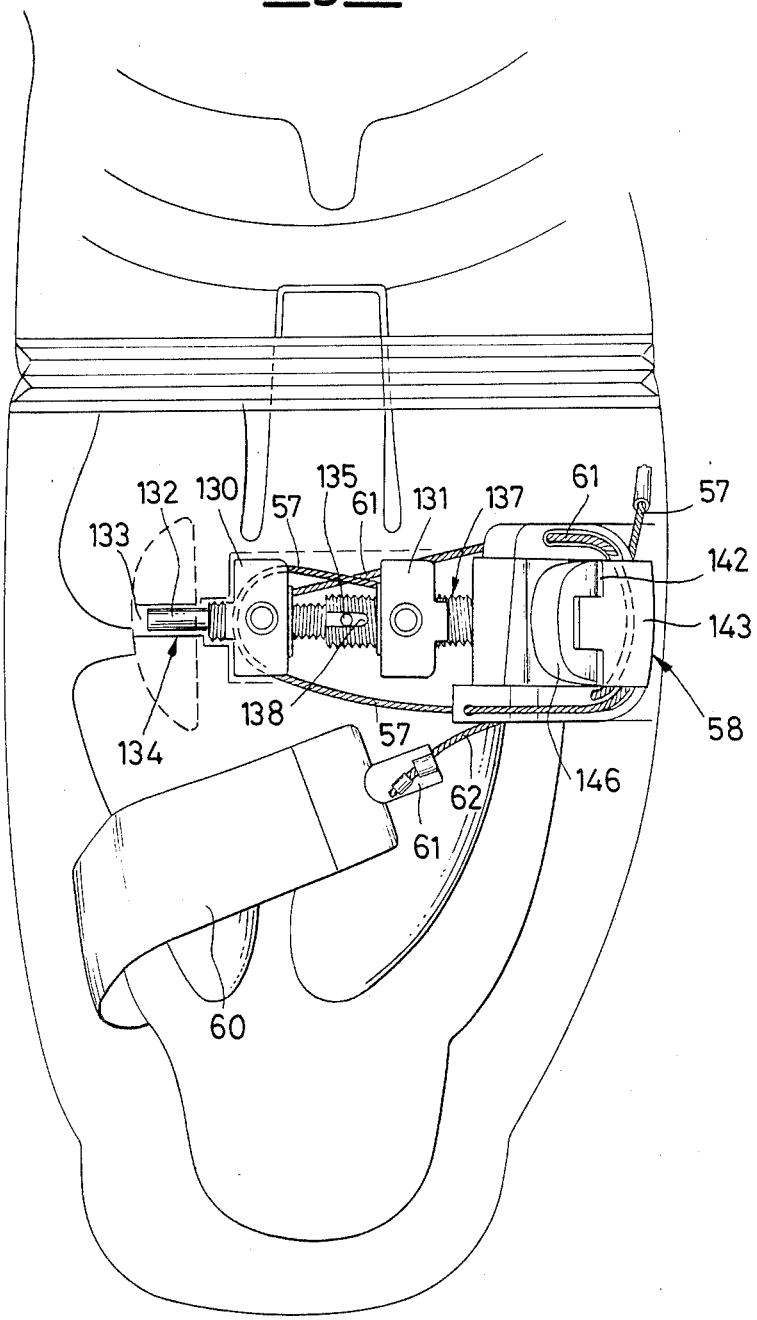
Figure 14:
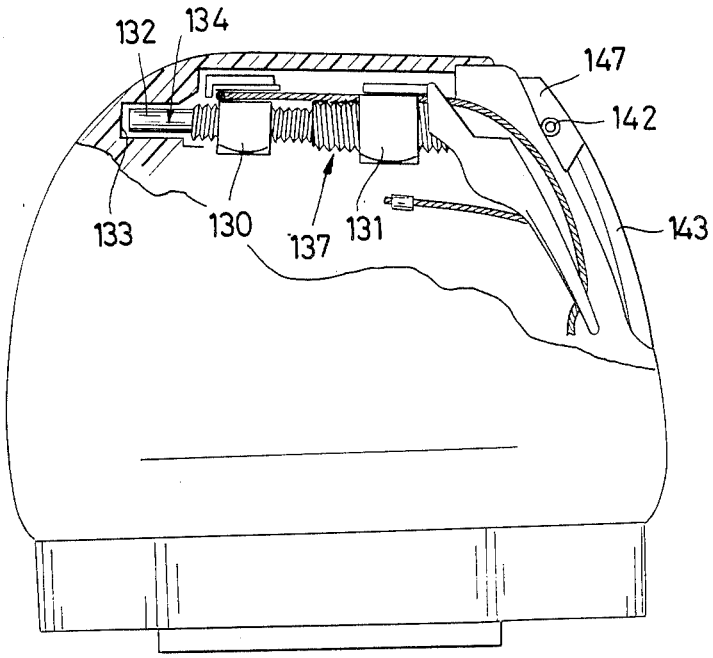

FIG. 11 is a view similar to FIG. 1 of a ski-boot according to the said third embodiment of the invention, FIG. 12 is a view, like FIG. 11, of the same ski-boot viewed from the other side, FIG. 13 is a partial plan view, from above, of the ski-boot of FIGS. 11 and 12, and FIG. 14 is a cross-section view, taken along the plane XIV—XIV of FIG. 12.

Considering first FIG. 1 there is shown a rear entry boot comprising a shell or rigid body 10 in which can be identified a sole 11 and an upper 12 while a boot leg part 13 is hinged to the shell at the pins 14.

The boot leg part is divided in an essentially vertical direction in two halves 15 and 16 with which are integral the spoiler 17 and the tongue 18 respectively.

To keep the two halves 15 and 16 closed with the boot in the closed condition there is provided a hook and rack device indicated as a whole by reference number 19.

Inside the rigid shell 10 there is housed the inner liner 20 which rests on the inner sole 21 which as usual separates the bottom of the shell from the liner and supports the latter.

The inner sole 21 comprises a heel 50 which is fixed to the bottom of the shell by means of screws 51 or similar means while at the front the inner sole 21 is inserted in an undercut of the shell 10.

In accordance with the present invention the inner sole 21 is formed integrally with at least two clamping half-bands 22 which depart from the heel, which is in this manner entirely surrounded, and turn upward until they reach the dorsum of the foot or in this case of the liner 20. The two adjacent edges 37 of the two half-bands are connected by a closing or clamping device, e.g. of the type illustrated in FIGS. 8 and 9 described below, actuatable from the outside of the shell 10.

From FIGS. 1 and 6 it appears clearly that by closing the clamping device the inner liner 20 with the foot enclosed therein is clamped firmly to the inner sole 21 and hence to the shell 10 so that movements imparted by the skier through the leg and the boot leg 13 are transmitted without play to the shell and to the ski integral therewith.

At the same time there are eliminated long and tortuously extending cables and pulls which unquestionably complicate the internal structure of the boot with no detrimental effect on the foot clamping function.

Another important benefit achieved thus lies in the fact that the pins which hinge the boot leg to the shell can be and are brought back to a higher position restoring the conditions of transmission of control commands of the foot to the shell and the ski, i.e. bringing back said transmission toward the tip of the boot.

Another benefit lies in the fact that the absence of traction cables and the concomitant lateral offsetting of the closing of the two half-bands avoid the creation of pressures localized on the instep at the malleolus articulation. In previous designs said problem was avoided by increasing the padding of the liner with the obvious drawbacks thereof or placing between the shell and the liner a reinforcing element or a tension spreading member.

In this respect it is appropriate to point out the fact that the present invention differs conceptually from the known art in the fact that the clamping band-like member, i.e. the two half-bands 22, is fully integral with the inner sole with which the boot is normally equipped and not with the shell or the liner. In the latter case either the localized pressure must be severe to ensure clamping of the foot or it is not possible to ensure safe clamping.

Figure 3:
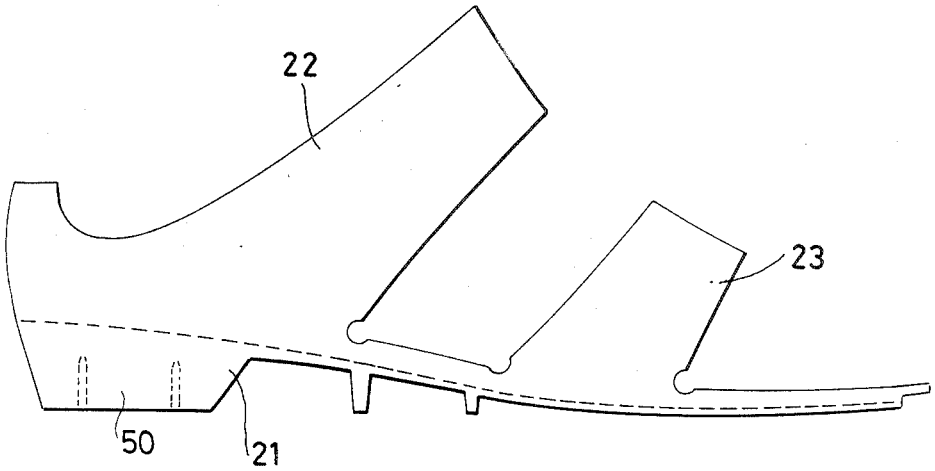

FIGS. 3, 4 and 5 show alternative embodiments of the inner sole 21 and the clamping band-like members. In the embodiment of FIG. 3, in addition to the half-bands 22, there is provided a second pair of half bands 23 which engage the foot or rather the liner containing it at the metatarsal region. It is clear that for the half-bands 23 also there may be provided a closing or clamping device such as the one provided for the half-bands 22 and likewise operated from the outside. In the embodiment of FIG. 4 besides the pairs of half-bands, there is provided a support 24 of the tendon zone of the foot which contributes to clamping of the foot and liner against the shell of the boot.

Finally the embodiment of FIG. 5 is distinguished by the fact that there is added a front restraining and clamping band-like member 26, the entirety being produced integrally in a single piece with the inner sole 21.

It is worthy of note that the shaping of the inner sole 21 with the half-bands 22 and 23, the support 24 and the band-like member 26 leaves free the space in which fit the bony protuberances of the foot in such a manner as to not diminish the comfort of wearing and using the boot.

Now considering FIGS. 8, 9 and 10 there are shown only as examples two possible embodiments of the closing and clamping device of the half-bands 22 and optionally of the half-bands 23.

In the embodiment of FIG. 8 the edge of each half-band 22 is integral with a L-shaped metal plate 27 in the vertical or protruding part 28 of which is formed a threaded hole. The two plates 27 are connected by a rod 29 having two opposed threadings each of which engages the threaded hole of the associated plate 27. With one end of the rod there is integral an operating handle 36, e.g. of the lever type, protruding from the shell of the boot to permit operation from the outside. Rotation of the handle and hence of the threaded rod in one direction or the opposite direction causes mutual approach or withdrawal depending on the direction of rotation of the adjacent edges 37 of the two half-bands 22 and hence clamping or unclamping.

In the embodiment of FIGS. 9 and 10, (which show the clamped and unclamped positions respectively of the closing and clamping device of the two half-bands) with the two edges of the half-bands 22 there are integral anchoring member 29 and a sleeve 30.

To the anchoring member 29 is fixed permanently one end of a length of cable 31, e.g of braided metal wire, the other end of which is fixed to a bar 32 which is fixed to a pin 33. The bar 32 runs through the axial hole of the sleeve 30 the end of which engages in a freely running manner a hole in the shell 10 and more specifically in the upper 12 of the shell 10.

On the pin 33 is pivoted an operating lever 34 formed with a cam part 35. The cam 35 in the closed position of the lever (shown in solid lines in FIG. 9) presses against the end of the sleeve 30 forcing it to run along the bar 32 so that the adjacent edges of the half-bands 22 are brought together while clamping or closing is effected.

Releasing or opening the lever 34 (in the position shown in FIG. 9 in broken lines) the cam 35 disengages the end of the sleeve 30 which is thus free to run outward due to the material elasticity of the two half-bands 22 causing cessation of the clamping action on the foot and on the liner containing it.

To secure fine adjustment the lever 34 may be rotated around the axis of the bar 32 with a screwing or unscrewing action in such a manner as to shorten or lengthen the section of cable 31 between the two sleeves 29 and 30 and then adjusting the clamping action when said lever is rotated around the bar 32 between the clamped and unclamped position.

It thus appears clear that the present invention permits achievement of the desired object without modifying the conventional structure of the boot.

Now considering FIG. 7 there is shown application of the present invention to a shoe such as a work boot, sports shoe such as a long-distance shoe, skating boot, motorcycling boot and the like. In this case there is no rigid shell, at least not at upper 12, and the liner constitutes the outer top envelope of the shoe.

The structure in accordance with the invention in this case acts directly on the foot which is covered by the usual stocking or sock, the half-bands 22, 23 being optionally equipped with appropriate inner padding. Naturally all the designs of the clamping structure of the foot shown in FIGS. 2-5 are applicable in this case as are applicable the clamping and tightening devices of FIGS. 8 and 9. In this embodiment furthermore the absence of the rigid shell in the upper part of the shoe permits adoption of other clamping devices and means given the ease of access to the half-bands 22.

Turning now to the embodiment of FIGS. 11 to 14, a rear entry ski boot is showns, comprising (using wherever possible the same reference numbers of FIG. 1) a shell or rigid body 10, a sole 11 and an upper 12, while a boot leg 13 is hinged to the shell at the pins 14.

The two halves, 15 and 16, forming the boot leg part 13 have, integrally formed therewith, the spoiler 17 and a tongue (not shown) respectively. To keep the two halves 15 and 16 closed with the boot in the closed condition, there is provided a hook and rack device indicated as a whole by the reference number 19.

It is to be noted that the inner parts of the ski boot are seen in these figures, since it is supposed that the shell or body 10 is of transparent material.

Inside the rigid shell 10 there is housed the inner liner 20 which rests on the inner sole 21 comprising a heel 50 which as usual separates the bottom of the shell from the inner liner and supports the latter.

Within the shell or body 10 a band-like member 51 is provided, extending transversely of the upper, at the height of the foot dorsum.

A shaped plate 52 extends along the inside of the shell 10, following the profile of the foot dorsum down to the metatarsal area and protecting the dorsum of the foot from localized pressures.

One end of the band 51 (FIG. 12) is fastened by means of a clamp 53 to the end of a tie cable 54, the other end of which is fastened to a small block 55 permanently anchored to the body 10. The other end of the band 51

(FIG. 11) is fastened through a clamp 56 to the end of a tie cable 57, slidably fixed to the internal surface of the shell 10 and ending at the clamping device indicated as a whole by the reference 58.

This clamping device is detailedly shown in the FIGS. 11, 13 and 14, and comprises two anchoring members, respectively 130 and 131, each having an axial screw threaded hole. A tie bar 134, externally screw threaded, is threadedly engaged with the axial hole of the anchoring member 130.

The outer end 132 of the tie bar 134 is permanently housed in a suitable seat 133 provided in the shell 10.

Intermediately the tie bar 134 is provided with a transverse pin 135, the ends of which radially protrude from the tie bar 134 and are housed in corresponding slots 138 formed in the sleeve member 137, to be hereinafter described.

The other end of the tie bar 134 is slidably housed in the axial hole of the sleeve member 137 the latter being externally screw threaded and engaged with the said threaded hole of the anchoring member 131.

The external treads of the tie bar 134 and of the sleeve member 137 are of opposite hands, whereby the rotation of the sleeve member 137 around its axial direction, thanks to the pin and slot connection to the tie bar 134, causes the rotation of the latter too and thus depending on the rotation direction the anchoring members 130 and 131 are simultaneously brought towards or away from each other.

The other end of the sleeve member 137 is rigidly connected to the base plate of an U-shaped bracket, the sides of which are fixed to the pivoting axis or cross pin 142, on which a control lever 143 is pivotally mounted.

The control lever 143 is rigidly connected to a cam part movable together with the lever 143 between an unclamping position and a clamping position.

The control lever 143 and the related came part are in principle shaped as the cam and handle arrangement of FIGS. 9 and 10 whereby no further description is necessary.

In this case however, the cam part is acting on the end of the tie bar 134 protruding through a suitable hole provided in the base plate of the said bracket, this end of the tie bar being arranged with means, like a portion, preventing the tire bar from slidingly coming out of the axial hole of the sleeve 137.

The cross pin 142 is supported by lateral shoulders, provided in a seat provided in the shell 10, the block 146 being thus rotatable in the said seat but not removable therefrom.

The reason for the rotatability of control lever connected thereto, is that of providing a fine adjustment of the clamping force acting on the foot or on the inner liner.

The tie cable 57 is connected to the anchoring member 131, but following the path indicated in FIG. 13, namely passing around the other anchoring member 130, whereby the actuation of the lever 143 and then the engagement of the cam part thereof causes the axial displacement of the latter and the anchoring members are moved away from each other applying consequently a tension to the tie cable 57. This tension causes in turn the band 51 to be tightened against the foot or the inner liner.

According to a preferred embodiment a half-band member 60 is provided, having one end integrally connected to the inner sole 21. The free end of the band 60 is fastened, by means of a clamp 61 to the end of a tie cable 62. The latter has the other end fastened to the anchoring member 130, in this case too the path of the tie cable 62 passing around the anchoring member 131, whereby the clamping of the control lever 143 causes in the same manner the tensioning of the tie cable 62 and thus the tightening of the half-band 60: the end portion of the foot or of the inner liner is consequently safely clamped to the inner sole 21.

The invention has been described for preferred embodiments, it being understood that conceptually and mechanically equivalent modifications and variants are possible and foreseeable without exceeding the scope thereof.

I claim:

1. A foot clamping structure for a boot, comprising:

a rigid shell having a bottom;

an inner liner;

an inner sole disposed between said bottom and said liner and fixed to said shell;

at least one band member having one end connected to said shell immediately beneath the malleolus articulation of a foot present in the boot, said band member being engageable with the dorsum of the foot;

clamping means connected to said at least one band member and actuable from outside the boot for clamping said at least one band member against the dorsum of the foot, said clamping means being positioned towards an upper front part of the boot, said clamping means being actuable between a first open position in which at least one band member does not press against the foot dorsum and a second clamping position in which said at least one band member is adjustably pressed against the foot dorsum, said clamping means comprising a flexible element having a first end integral with a fixing element secured to a terminal edge of one of said band members and a second end integral with a pivot pin of a control lever operable between an open and a closed position, a sleeve element rigidly fixed to a terminal edge of another band member and mounted to extend axially with respect to said flexible element, said control lever being provided with a cam part for engaging one end of said sleeve element to push said sleeve element towards said fixing element when said control lever is in said closed position;

a first tie cable fixed to an anchoring member of said clamping means, the other end of said at least one band member being connected to said first tie cable, said first tie cable being engageable with a movable member of said clamping means, said movable member being removable from said anchoring member of said clamping means when said clamping means is brought into said clamping position, whereby tension is applied to said first tie cable and said band member is clamped against said foot dorsum; and a second tie cable connected at one end to said movable member of said clamping means, said second tie cable being connected at the other end to a first edge of a band member, the other edge of which is anchored to said inner sole, said band member embracing a part of the foot before the big toe, whereby said band member, when clamped by said clamping means, clamps the foot to said inner sole.

2. A clamping structure according to claim 1, wherein said at least one band member is integrally formed with said inner sole and embraces laterally said inner liner from a region where the heel of a foot is present upwards towards the foot dorsum, said at least one band member being formed in two separate half-bands at a zone of an upper ridge position of the foot dorsum, said clamping means being disposed outside said boot for urging terminal edges of two half bands towards and away from each other.

3. A clamping structure according to claim 2, wherein said band member is shaped to surround the heel of the foot, said half bands extending upward so as not to interfere with bony protuberances of the foot.

4. A clamping structure according to claim 3, wherein two band members are provided, the second of which is located at the metatarsal region of the foot.

5. A clamping structure according to claim 3, wherein a front band member is provided at the instep above the malleolus articulation of the foot.

6. A clamping structure according to claim 1, wherein said liner is not present and said at least one band member acts directly on the foot.

7. A clamping structure according to claim 1, and further including a shaped flexible plate which is shaped according to the profile of the foot dorsum from the malleolus to the metatarsal area and is interposed between said band member and the dorsum of the foot.

8. A clamping structure according to claim 2, wherein a shaped flexible plate which is shaped according to the profile of the foot dorsum from the malleolus to the metatarsal area and is interposed between said half band and the foot dorsum.

* * * * *